US010100593B2

(12) United States Patent
Musemeche

(10) Patent No.: US 10,100,593 B2
(45) **Date of Patent: *Oct. 16, 2018**

(54) POWER TONG UNIT

(71) Applicant: Mech Tech Engineering LLC, Broussard, LA (US)

(72) Inventor: Clint Musemeche, Youngsville, LA (US)

(73) Assignee: MECH TECH ENGINEERING, LLC, Broussard, LA (US)

( * ) Notice: Subject to any disclaimer, the term of this patent is extended or adjusted under 35 U.S.C. 154(b) by 275 days.

This patent is subject to a terminal disclaimer.

(21) Appl. No.: 15/049,270

(22) Filed: Feb. 22, 2016

(65) Prior Publication Data

US 2016/0168931 A1 Jun. 16, 2016

Related U.S. Application Data

(63) Continuation of application No. 13/500,372, filed as application No. PCT/US2011/043763 on Jul. 12, 2011, now Pat. No. 9,267,343.

(60) Provisional application No. 61/363,708, filed on Jul. 13, 2010.

(51) Int. Cl.
*E21B 19/16* (2006.01)

(52) U.S. Cl.
CPC ..... *E21B 19/161* (2013.01); *E21B 19/164* (2013.01); *Y10T 74/1993* (2015.01); *Y10T 74/19651* (2015.01)

(58) Field of Classification Search
CPC ..... E21B 19/164; E21B 19/16; E21B 19/168; E21B 19/161; E21B 19/10; E21B 3/04
See application file for complete search history.

(56) References Cited

U.S. PATENT DOCUMENTS

| | | | | |
|---|---|---|---|---|
| 860,586 A * | 7/1907 | Ellingham | ..... | A44B 11/18 24/193 |
| 4,372,026 A * | 2/1983 | Mosing | ..... | E21B 19/164 29/426.5 |
| 9,267,343 B2 * | 2/2016 | Musemeche | ..... | E21B 19/164 |

* cited by examiner

*Primary Examiner* — Robert Scruggs
(74) *Attorney, Agent, or Firm* — Law Office of Jesse D. Lambert, LLC

(57) ABSTRACT

A power tong unit having a gear train in which one or more of the gears in the gear train have removable and replacement roller tooth elements, in lieu of conventional gear teeth. In one embodiment, the ring gear and pinion gears have roller tooth elements, and idler gears disposed between the ring gear and pinion gears, have a semi-circular tooth root profile to mesh with the roller element gear teeth. The ring gear of the power tong unit may also have a removable section. A means for removing the removable section from the ring gear, and moving it to a position in which a tubular can be inserted into a central opening in the ring gear, may include a hydraulic cylinder, a clamping mechanism, and a cam surface to generate rotation of the removable section once lifted out of engagement with the ring gear.

4 Claims, 15 Drawing Sheets

POWER TONG UNIT

CROSS REFERENCE TO RELATED APPLICATIONS

This patent application claims priority to United States provisional patent application Ser. No. 61/363708, filed Jul. 13, 2011, for all purposes.

BACKGROUND

Apparatus commonly known in the art as "power tongs" are used to screw together (or "make up") and unscrew (or "break out") threaded tubular connections joining sections (frequently called "joints") of tubulars. Such tubulars are frequently used in the drilling, servicing and completion of oil and gas wells, in the form of drill pipe, tubing, and other similar tubular goods. Such apparatus are commonly referred to as "tong units" or "power tongs," which use toothed dies carried by tong jaws, to transmit torque to the tubular connection. While power tongs take various forms, typically the tong jaws are rotated by a ring gear, which may be in turn rotated by one or more, typically two, idler gears. The idler gears are rotated by a gear rotated by a power rotary source, typically a hydraulic motor; this gear (the driver gear) is commonly known as a pinion gear. The different gears, taken together, form a gear chain.

Some power tongs are known as "open throat" tongs, which means that the body and ring gear of the tongs have a window or opening which permits a tubular to be moved into and out of the central opening of the ring gear. Other power tongs are of the closed throat configuration, which means that the tubular must be inserted longitudinally into the ring gear opening. Open throat tongs typically have a gear train comprising one or more idler gears. Closed throat tongs may omit the idler gear(s), and drive the ring gear directly by the pinion gear.

It is to be understood that the foregoing description of moving a tubular into and out of the central opening of the power tong is merely one way to describe relative movement between the tubular and the power tong; same could also be described as moving the power tong into and out of position around the tubular.

As can be understood, the tooth elements of the gears of the gear chain wear over time, causing increased vibration and noise in operation of the tong. In known prior art power tongs, remediation of this situation involves replacement of the gears, with the worn gear teeth being re-machined if possible. It can be appreciated that replacement of an entire gear due to tooth wear is expensive, particularly in the case of the ring gear, which is a large, heavy and expensive component.

Open throat tongs, while offering increased convenience and operational efficiency due to the ability to open the tong unit up and place it around the tubular, have the structural drawback of a discontinuous ring gear and tong housing. Under high load (i.e. high torque) conditions, the ring gear and/or housing can open up or spread, resulting in a loss of transmitted torque. Known open throat tong designs have attempted to lock in the removable ring gear section to the balance of the ring gear, with various limitations on same. In addition, known open throat tong designs require one or more personnel to manipulate, by hand, the door on the front of the tong which creates the open throat. This requirement of personnel presents efficiency and safety issues.

SUMMARY

In a power tong, whether of the open throat or closed throat type, comprising a gear train, the current invention comprises one or more gears in the gear train having removable and replaceable roller tooth elements in lieu of conventional gear teeth. This permits replacement of worn roller tooth elements when needed, in lieu of repair of gears via machining or replacement of the various gears in the gear train. The gear(s) meshing with the roller tooth elements having a suitable tooth and tooth root shape, which may include a generally semi-circular tooth root shape.

One aspect of the invention further comprises an open throat power tong having a ring gear with a removable section, and a remotely operable power means for moving the removable ring gear section out of and into locking engagement with the remainder of the ring gear ring gear. The invention enables operation of the tong without hands-on operator intervention to open/close the throat of the tong, and by the locking aspect prevents spreading of the ring gear under load.

In more detail, this invention relates to a tong unit which comprises:

- gears, namely a ring gear, in some embodiments idler gears, and a pinion gear, one or more of these gears having independent roller tooth elements in lieu of standard gear teeth, with the independent roller tooth elements being separately replaceable;
- the mating gears to these roller tooth element gears having an appropriate profile, which may comprise a non-standard tooth geometry, including a semi-circular tooth root profile;
- in one embodiment, an open throat tong unit having a ring gear having a removable section, and a door to the throat of the tong, the door carrying a hydraulic clamp or caliper mechanism which clamps the ring gear removable section, the door/ring gear removable section then lifted, then lifting the removable section out of engagement with the ring gear and rotating same by a hydraulic cylinder/cam assembly, to open the throat of the tong.

DETAILED DESCRIPTION OF ONE EMBODIMENT OF THE INVENTION

Figure 1:
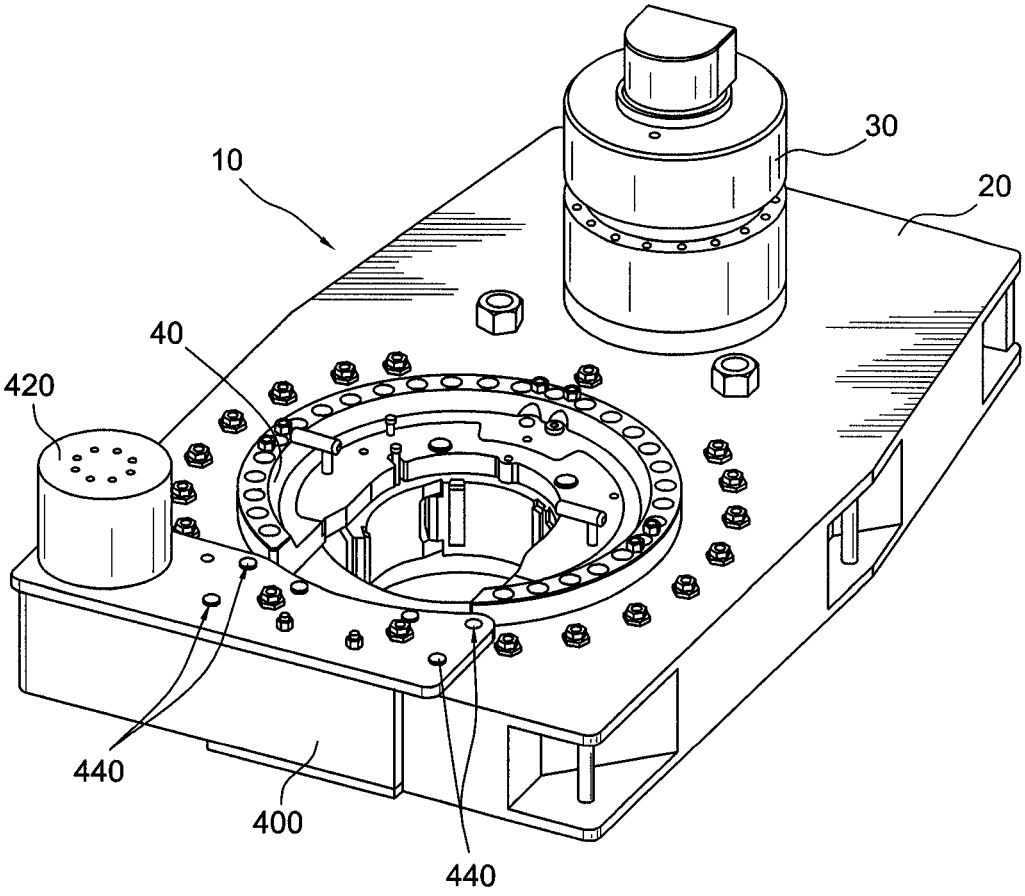
FIG. 1 is a perspective view of a tong unit embodying the principles of the present invention.
Figure 2:
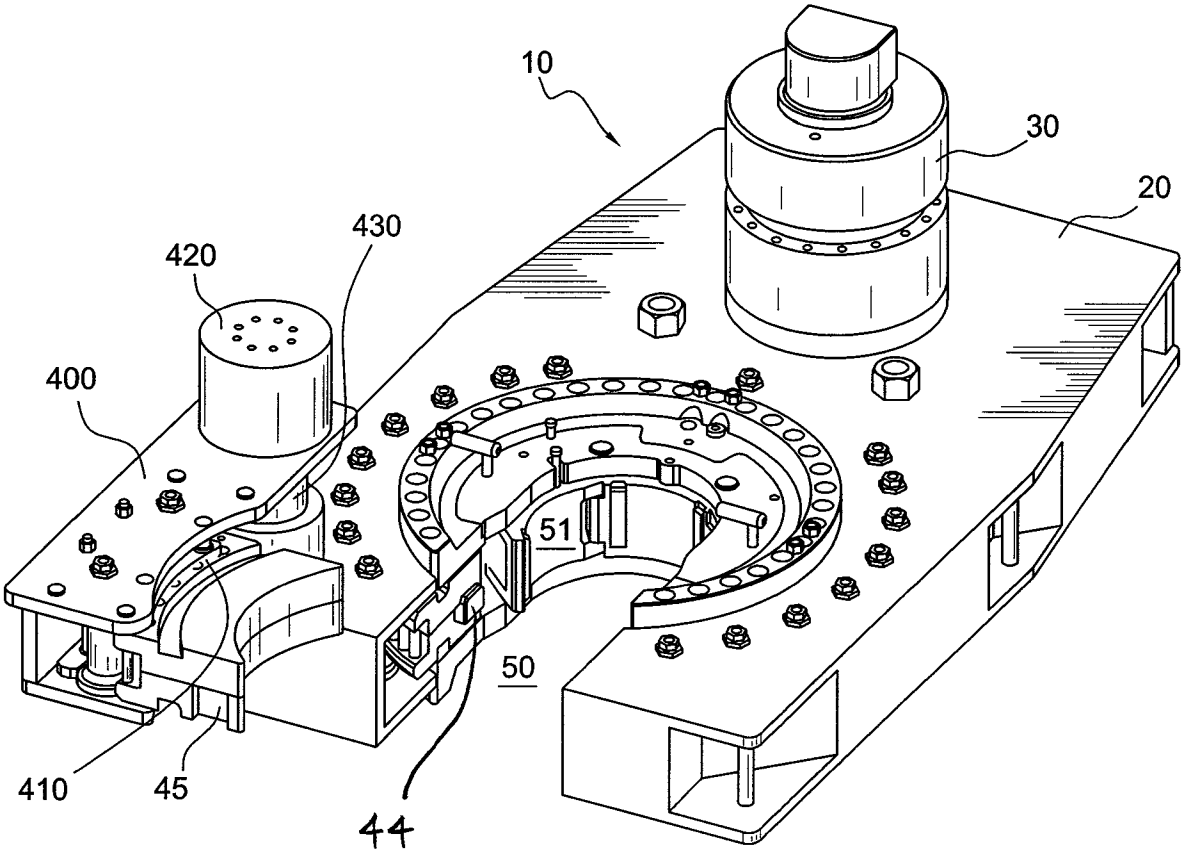
FIG. 2 is a perspective view of a tong unit embodying certain principles of the present invention, with the ring gear removable section lifted out of the ring gear and the tong door opened.
Figure 3:
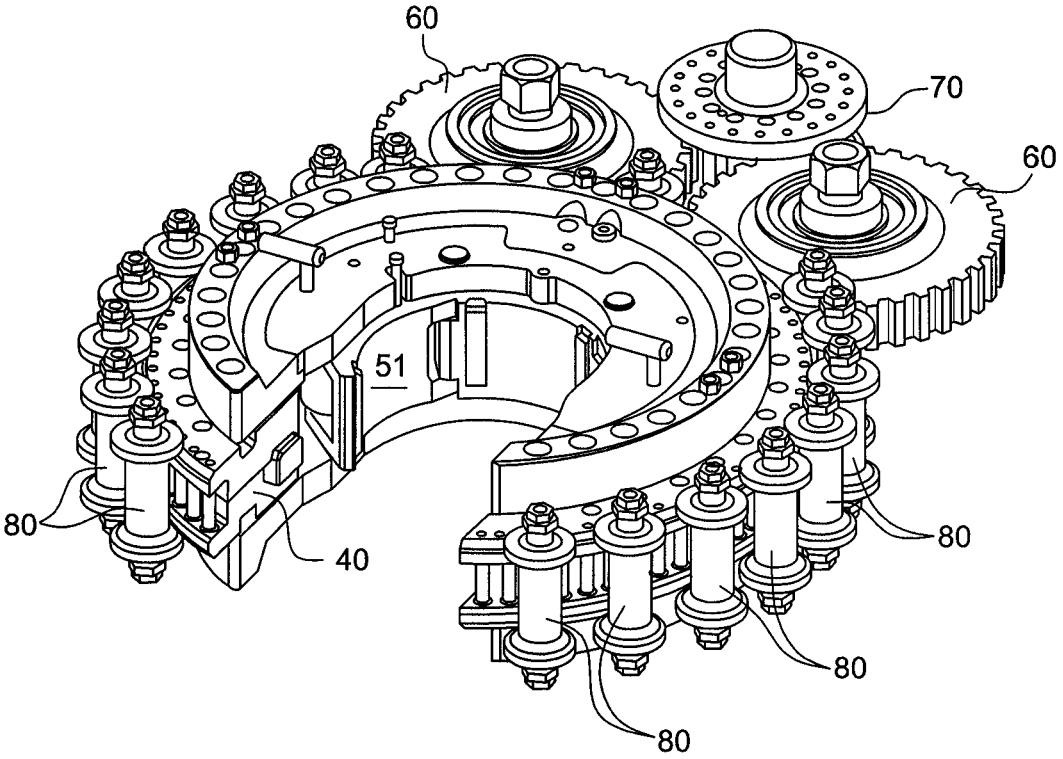
FIG. 3 is a perspective view of the gear train of an embodiment of the tong unit.

FIG. 1 is a perspective view of a tong unit embodying certain principles of the present invention, and shows various elements of the tong unit helpful to describe the invention. Reference is also made to FIGS. 2 and 3. Tong unit 10 comprises a main body 20, within which a ring gear 40 rotates. Rotary force is applied to ring gear 40 by one or more other gears, which may comprise idler gears 60, which are in turn driven by pinion gear 70. Pinion gear 70 is driven (rotated) by a power means, namely a motor 30, typically a hydraulic motor. By "power means" is meant any form or combination of hydraulic, electric, pneumatic, or other motor, alone or in combination with any sort of gear system. As an example, the power means may include a hydraulic motor driving a planetary gear system, which in turn drives the pinion gear. As can be seen in FIG. 2, ring gear 40 comprises a removable section, generally denoted by element 45, creating an open throat 50. Open throat 50 permits ring gear 40, and consequently tong unit 10, to be placed around a tubular so that the jaws of the tong unit (not shown) can engage and screw together/unscrew the tubular connection. While FIG. 1 (and certain other figures) illustrate an open throat tong unit, it is understood that certain principles of the present invention, namely the removable, replaceable roller gear teeth elements, equally apply to closed throat tongs, as will be later described.

FIG. 3 is a perspective view of the gear train of tong unit 10, with the main body components removed for clarity. The gear train may comprise ring gear 40, idler gears 60, and pinion gear 70. Certain embodiments of tong units (particularly closed throat tong units) may omit idler gears 60, and drive ring gear 40 directly by pinion gear 70. A number of rollers 80 provide support for ring gear 40 within main body 20.

The Ring Gear

FIGS. 3-7 show additional detail regarding the gear train, including ring gear 40.

Figure 4:
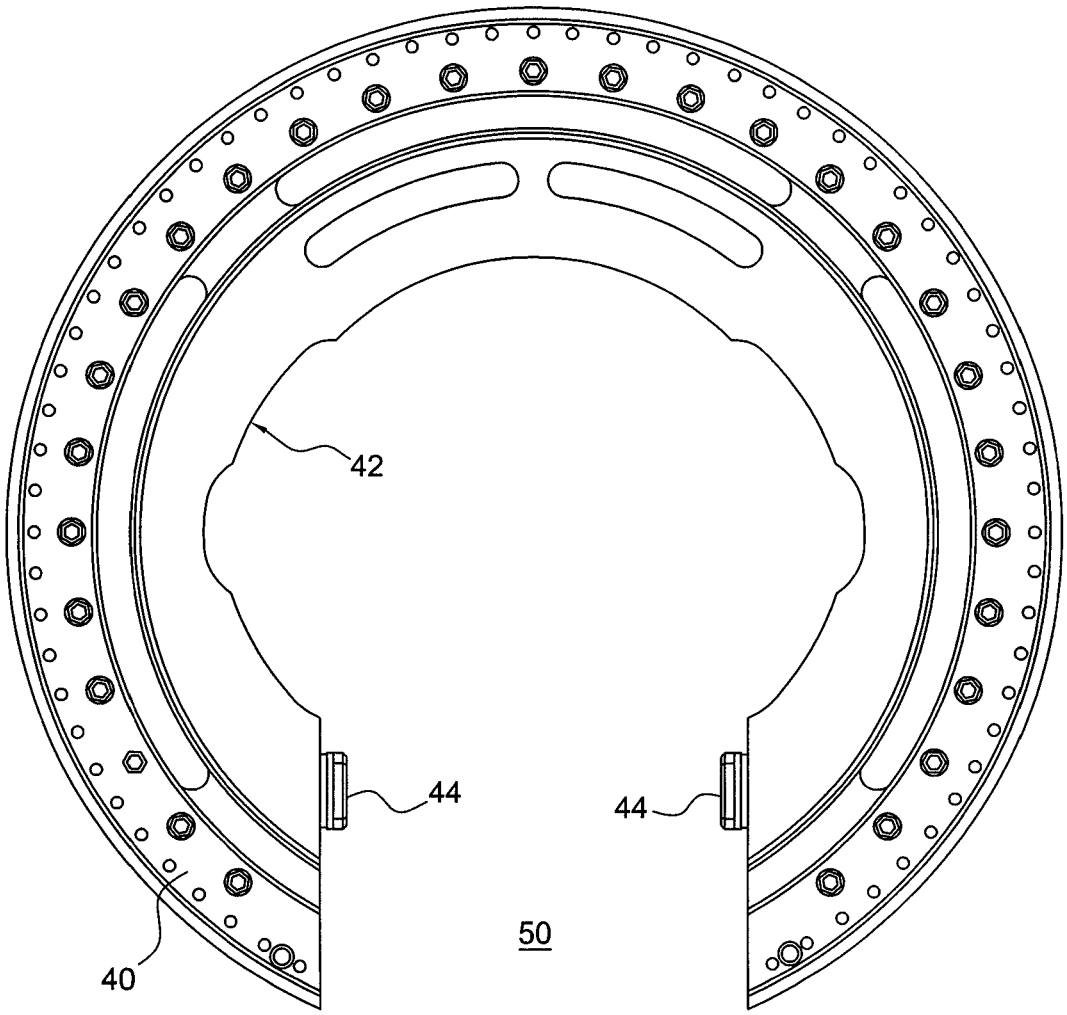
FIG. 4 is a top view of an embodiment of a ring gear, embodying certain principles of the present invention.

FIG. 4 is a top view of ring gear 40, showing throat section 50. As is typical of rotary tong units, the interior surface of ring gear 40 comprises cam surfaces 42, which engage jaw assemblies 51, and move them radially inward to engage a tubular positioned within the ring gear opening. Mating, locking surfaces on both the removable section 45 of ring gear 40, and the remaining part of ring gear 40 (denoted by element number 40) lock removable section 45 together with ring gear 40. One possible embodiment of locking surfaces comprises ring gear keys 44 positioned on either side of throat section 50. Ring gear keys 44 engage mating surfaces or slots 46 in removable window section 45, and lock it into place on ring gear 40. It can be readily understood that with removable section 45 in place, throat 50 of ring gear 40 is prevented from opening.

Figure 5:
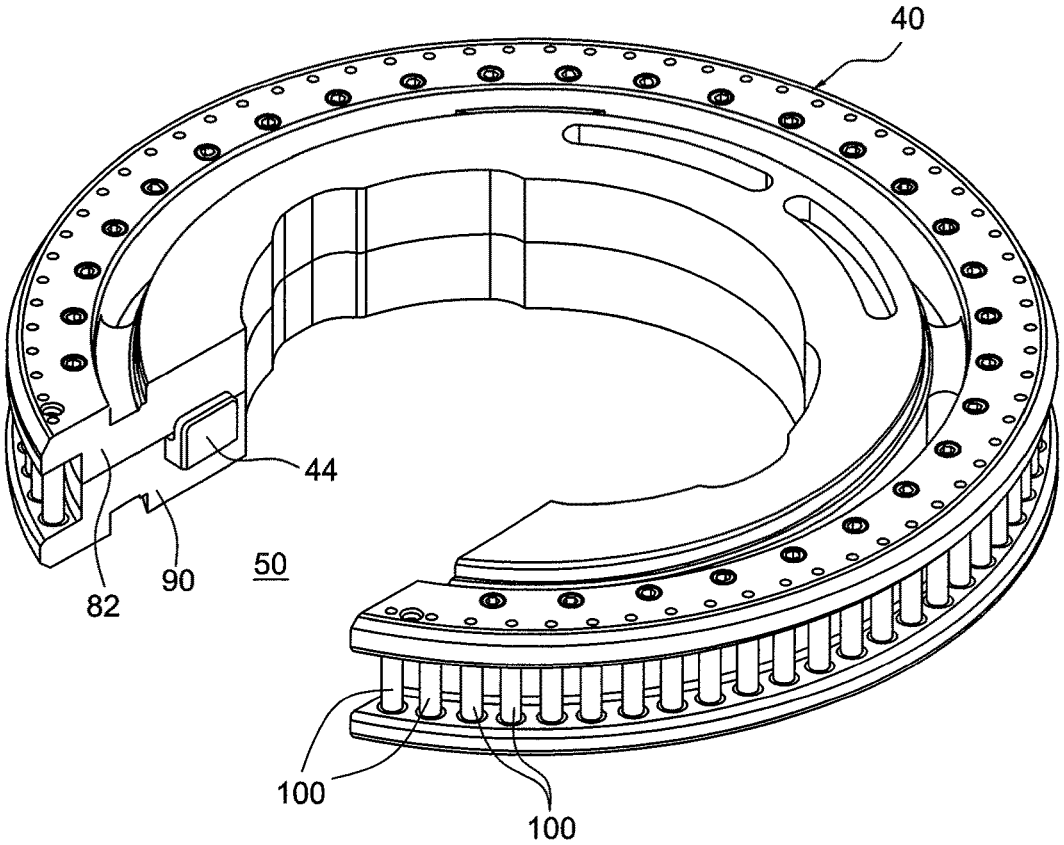
FIG. 5 is a is a perspective view of the ring gear of FIG. 4.

FIG. 5 is a perspective view of ring gear 40, showing throat 50, ring gear keys 44, and roller element teeth 100. The particular embodiment of ring gear 40 and removable section 45, shown in FIGS. 2-7, are of a "split" configuration, best seen in FIG. 7, where substantially identical halves (upper and lower plates) of ring gear 40 are bolted together to hold roller element teeth 100 in place. Alternate structures are possible, as will be described in connection with FIGS. 7A-7D.

Figure 6A:
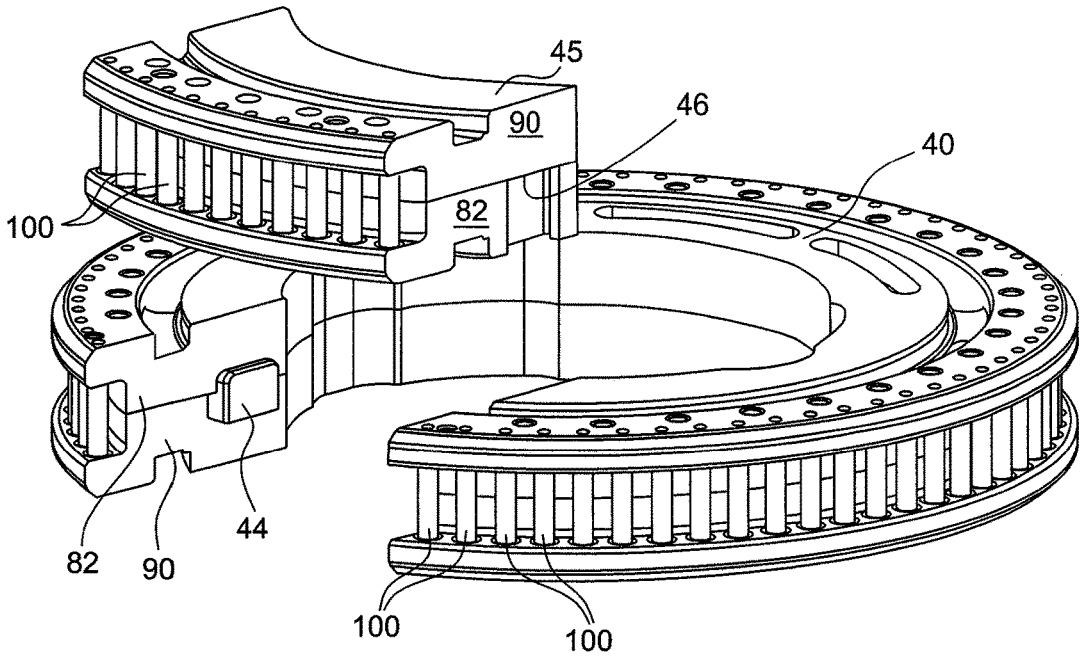
FIGS. 6A and 6B are perspective views of the ring gear of FIGS. 4 and 5, with the removable section elevated out of engagement (6A) and engaged (6B); also showing the roller tooth elements.
Figure 6B:
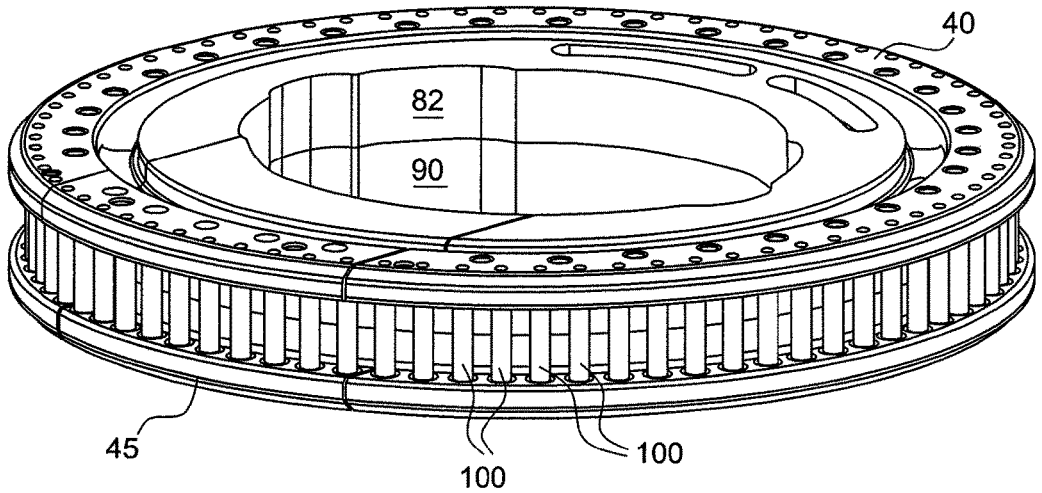

FIGS. 6A and 6B are perspective views of ring gear 40 with removable section 45 lifted out of place (FIG. 6A) and inserted in place (FIG. 6B). It can be appreciated that ring gear keys 44 engage mating slots 46 in removable section 45.

Figure 7:
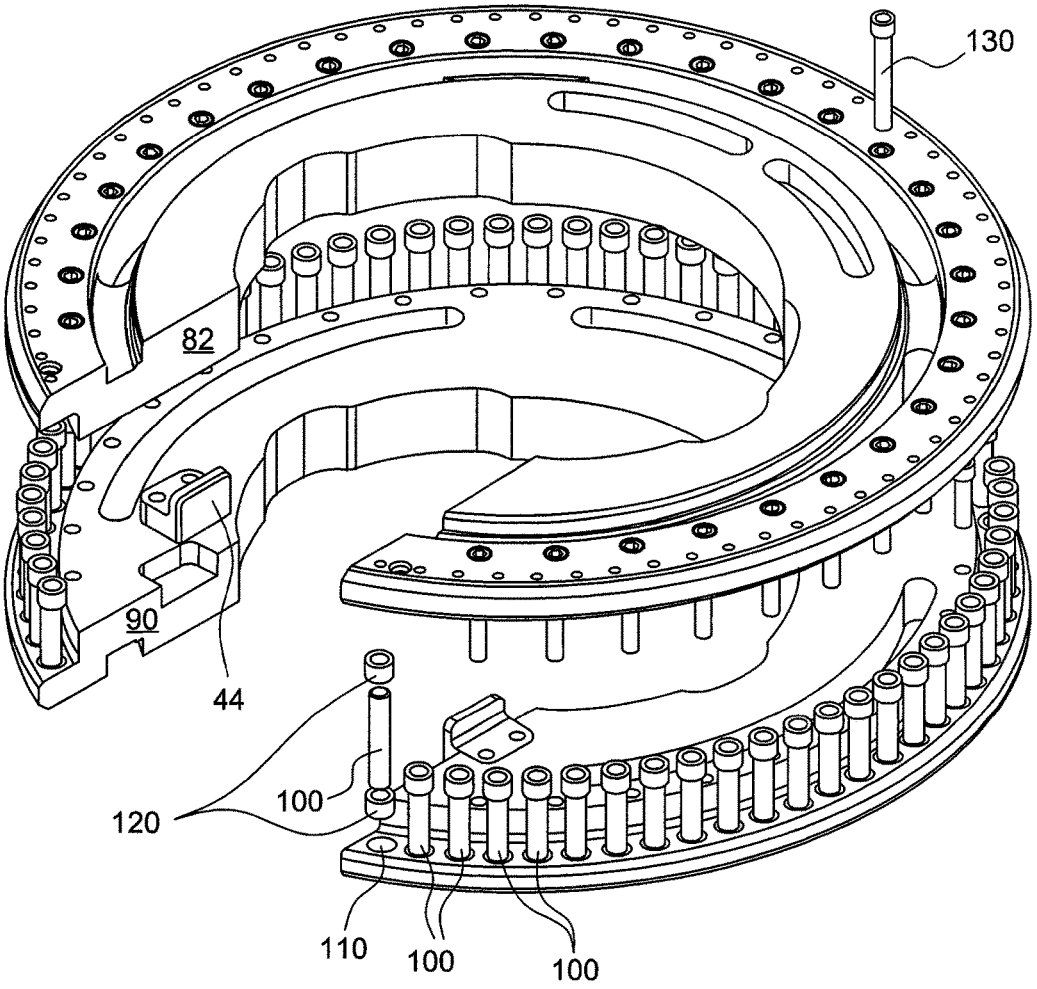
FIG. 7 is an exploded view of the ring gear showing additional detail of the roller elements.

FIG. 7 is an exploded view, and shows more detail regarding the various elements of ring gear 40. In FIG. 7, ring gear 40 is a two piece ring gear, in the sense that it comprises an upper plate 82 and a lower plate 90. The teeth of the ring gear are comprised of a plurality of roller tooth elements 100, disposed around the circumference of ring gear 40. As can be seen in FIG. 7, both upper plate 82 and lower plate 90 comprise a plurality of holes 110 around their periphery (the holes in lower plate 82 are best seen). Holes 110 do not fully penetrate the plates, but penetrate only a certain depth. Roller tooth elements 100 preferably have bushings 120 at both ends, which in a presently preferred embodiment are bronze bushings. As can be seen in FIG. 7, the roller tooth elements/bushing assemblies are placed into each of holes 110 in lower plate 90; then, upper plate 82 can be placed on top, so that the upper ends of the roller tooth elements/bushing assemblies fit into corresponding holes in the upper plate. Bolts 130 or similar fasteners join upper and lower plates 82 and 90 together, retaining the teeth/bushing assemblies in place. It is to be understood that, in the preferred embodiment, the roller element gear teeth 100 can freely rotate within bushings 120. Removable section 45, seen in FIG. 6, is fabricated and assembled in like fashion.

It is understood, however, that other embodiments of the present invention may comprise tooth elements 100 which do not rotate, but instead are fixed with respect to ring gear 40, and that the present invention comprises both rotating and non-rotating (both with respect to ring gear 40) tooth elements.

It can therefore be understood that ring gear 40 can therefore be of a two-piece design, with detachable top and bottom plates, which hold the roller tooth elements between the two plates. This assembly enables decreased costs of manufacture, and permits replacement of individual roller gear teeth, rather than expensive re-machining of the large gear.

Figure 7A:
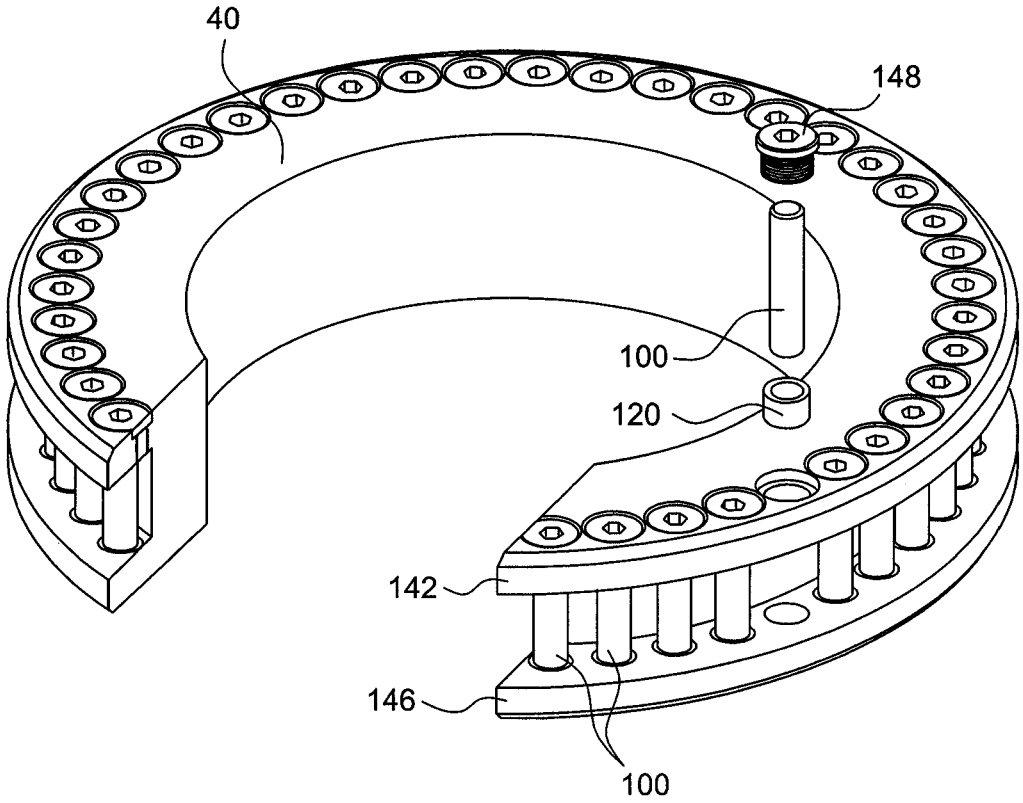
FIGS. 7A and 7B show another embodiment of the ring gear and roller tooth elements.
Figure 7B:
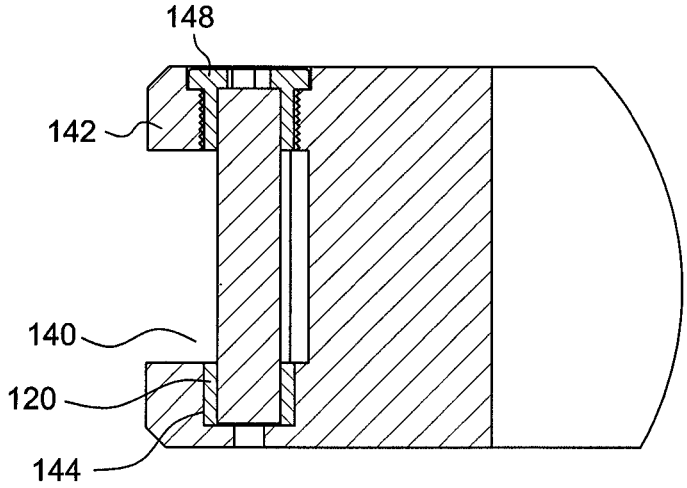
Figure 7C:
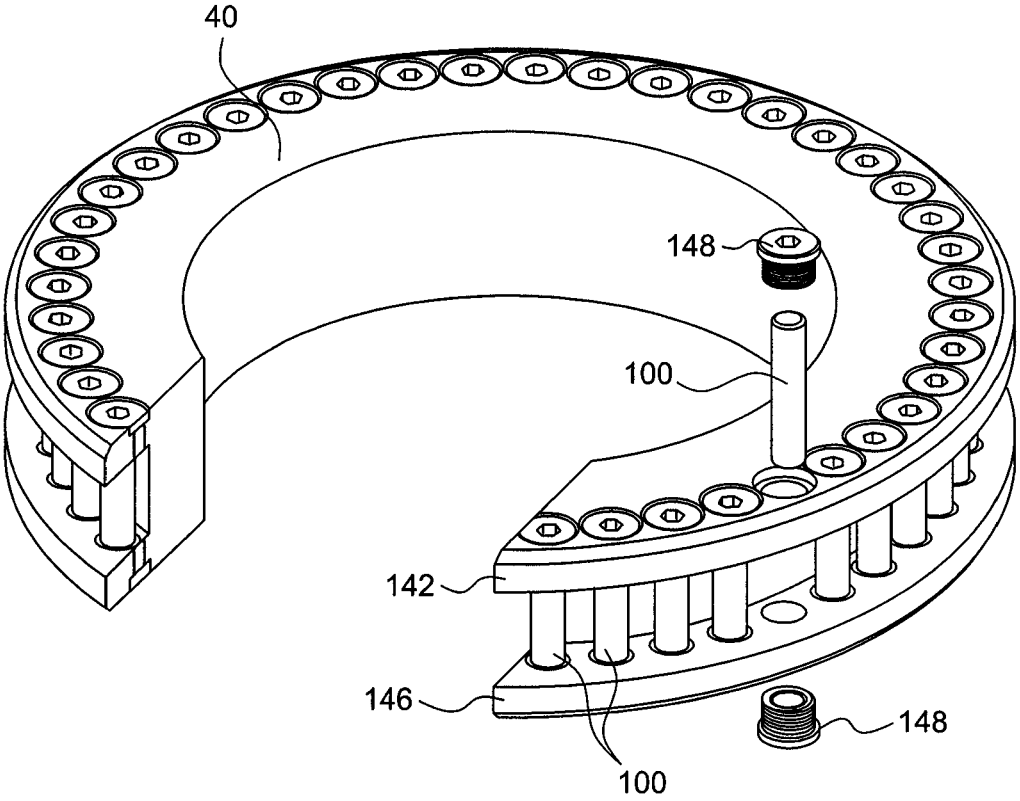
FIGS. 7C and 7D show yet another embodiment of the ring gear and roller tooth elements.
Figure 7D:
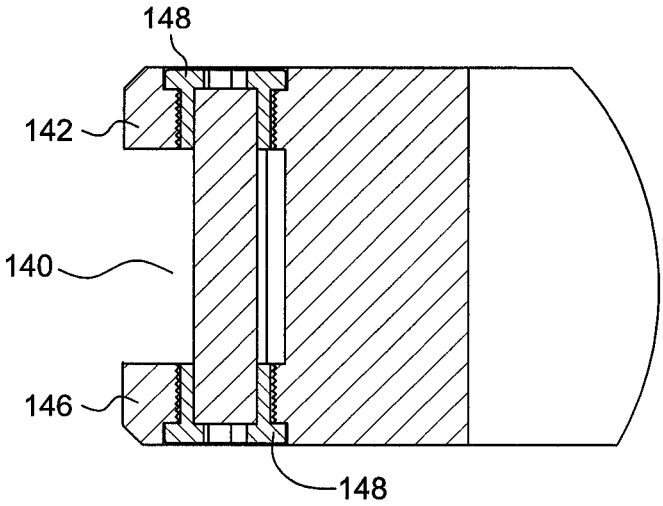

FIGS. 7A-7D shown alternate embodiments of ring gear 40. In these embodiments, ring gear 40, and removable section 45, are not split, as can be see in these drawings. Instead, a circumferential groove 140 is formed in the outer edge, into which roller tooth elements 100 fit. Different manners of retaining roller tooth elements 100 in ring gear 40 are possible. FIGS. 7A and 7B show an embodiment in which roller tooth element 100 is inserted from through a hole in upper lip 142 (as oriented in the drawings) of ring gear 40, down into a recess 144 in lower lip 146 of ring gear 40. The lower end of roller tooth element 100 preferably fits into a bushing 120, and a fastener, such as a threaded top cap 148, is screwed into upper lip 142 to retain tooth 100 in place, both of which can be seen in FIGS. 7A and 7B. In the preferred embodiment, top cap 148 is configured as a bushing, in addition to serving a retaining function. The embodiment shown in FIGS. 7C and 7D is similar, except that holes are in place in both upper and lower lips 142 and 146, and threaded end caps 148 are made up into both upper and lower lips 142 and 146 of ring gear 40, thereby retaining tooth 100 in place.

Figure 8:
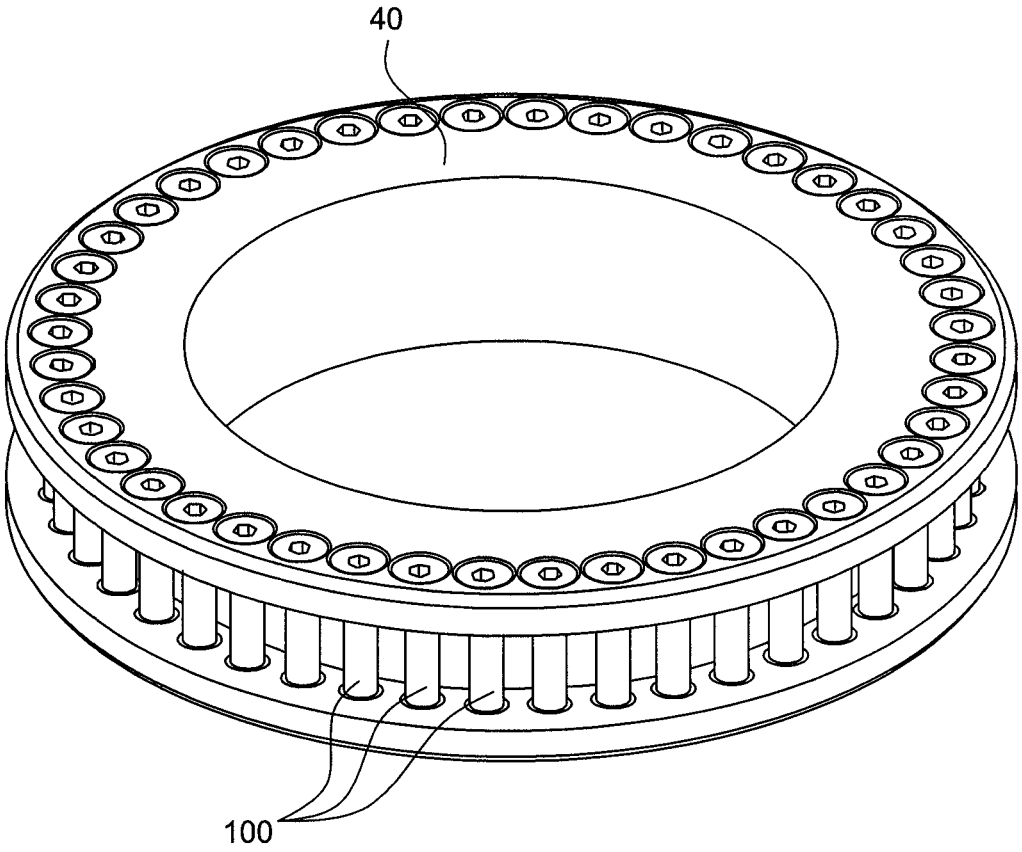
FIG. 8 shows a solid ring gear having roller tooth elements.

It is to be understood that the removable, replaceable tooth element aspect of the present invention applies also to closed throat power tongs. FIG. 8 is a perspective view of a ring gear 40 in a closed throat power tong, showing roller tooth elements 100, which may be retained in place on ring gear 40 by suitable means, including either of the end cap arrangements shown in FIGS. 7A-7D.

The Pinion Gear

Figure 8A:
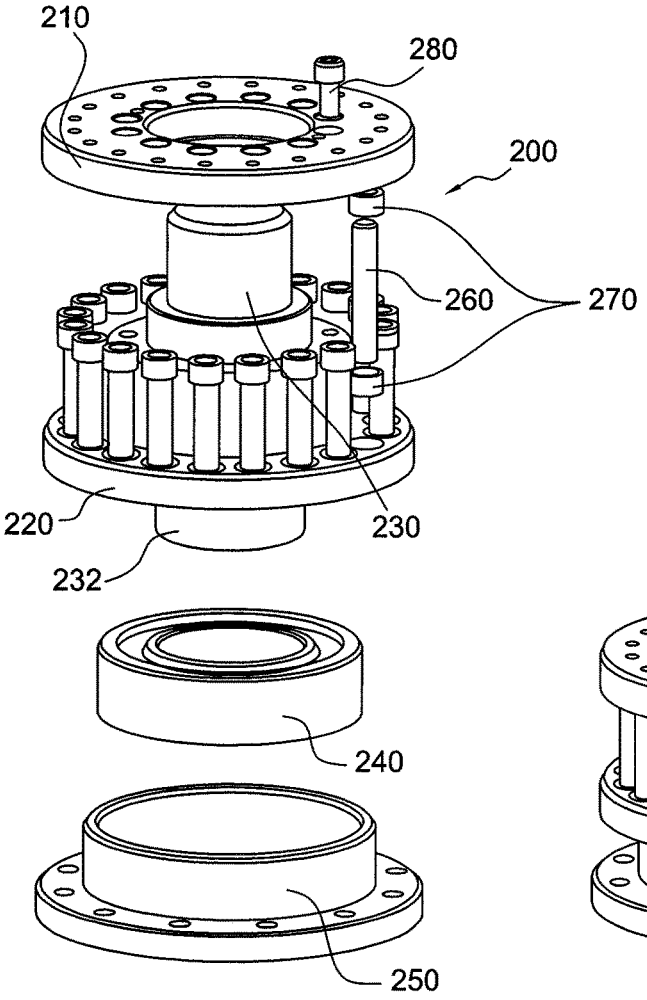
FIGS. 8A and 8B show a pinion gear in exploded and assembled views, embodying certain principles of the present invention.
Figure 8B:
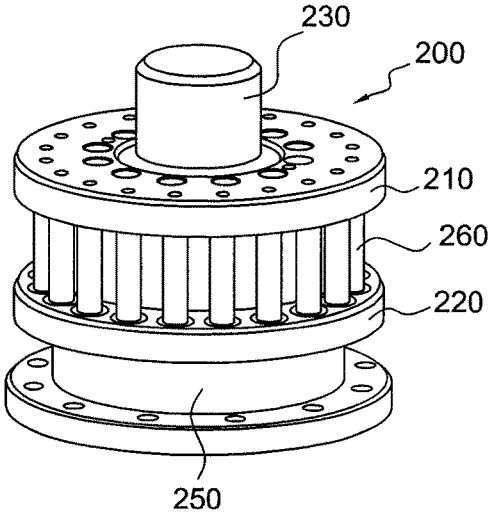

FIGS. 8A and 8B show detail of an embodiment of pinion gear 200. It is understood that pinion gear 200 is the gear driven by motor 30, and through the idler gears (described below) provides torque to ring gear 40. Pinion gear 200 comprises top and bottom plates 210 and 220, held on a main shaft 230. A lower extension 232 of main shaft 230 rotates in a bearing 240, in turn held in a bearing cap 250. Similar to ring gear 40, roller element teeth 260 preferably rotate within bushings 270, which in the preferred embodiment are bronze bushings. Bolts 280 hold top and bottom plates 210 and 220, and consequently roller element teeth and bushings, together.

The Idler Gears

Figure 9A:
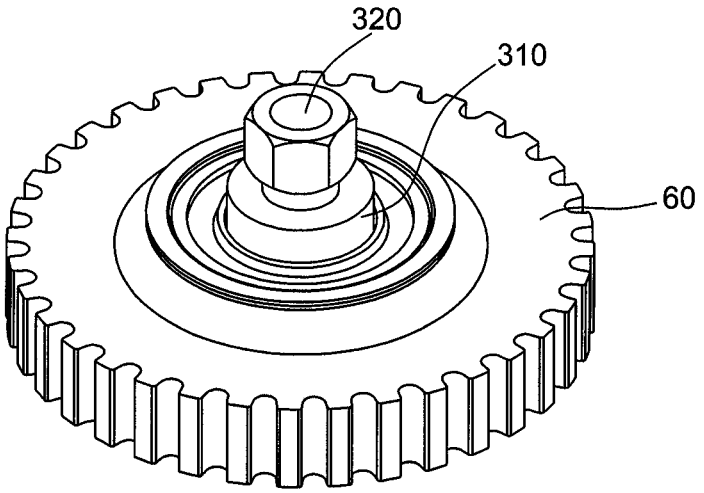
FIGS. 9A and 9B show perspective and top views of an embodiment of the idler gears.
Figure 9B:
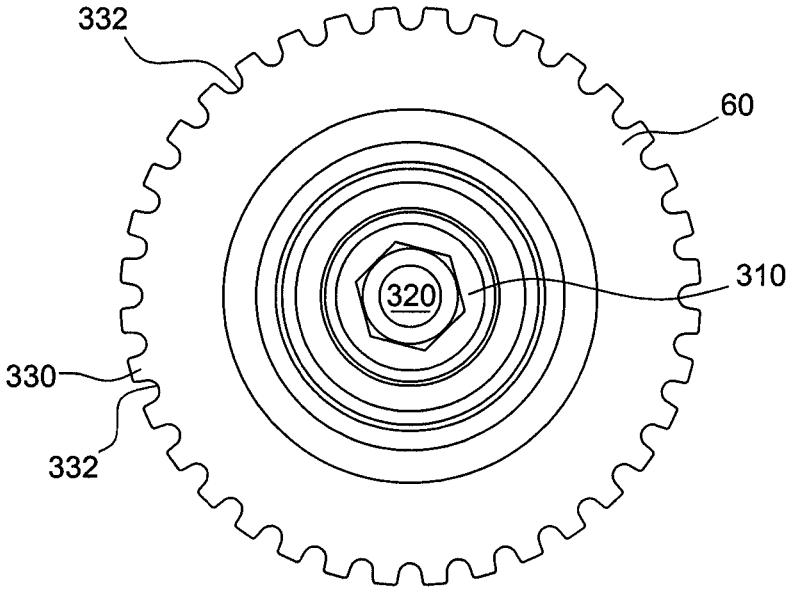

FIGS. 9A and 9B show detail of idler gears 60. Idler gears 60 rotate on shafts 310, which are held in main body 20 by nuts 320. As can be seen in FIGS. 9A and 9B, rather than conventionally shaped gear teeth, idler gears 60 may comprise non-standard gear teeth, namely gear teeth 330 having a generally semi-circular gear tooth root profile 332, which mate with the roller element teeth 100 and 260 of ring gear 40 and pinion gear 200. FIG. 3 shows this relationship. As is known in the art, and readily understood herein, especially by review of FIG. 3, torque is transmitted through the gear train by motor 30 turning pinion gear 200; which turns idler gears 60; which turn ring gear 40.

The structure of the various gears in this gear train offer numerous advantages over the known prior art. In the event of wear or breakage of any teeth in the pinion or ring gear, the construction of said gears enables easy disassembly of the gear, and replacement of the worn or broken tooth/bushing assemblies. Prior art designs required machining of teeth on very large and heavy solid gear assemblies. The mating tooth shape (in the example shown, on the idler gears), which may have semi-circular gear tooth root shapes, in combination with the roller tooth elements of the pinion and ring gears, provides excellent torque transmission and quiet operation.

It is to be understood that while the foregoing description and drawings are directed toward a tong configuration which comprises one or more idler gears, and in which the pinion or powered gear and the ring gear have roller teeth elements, with the idler gears having "solid" teeth to mate therewith, this is not the only configuration encompassed by the present invention. For example, the idler gear(s) could have the roller teeth elements, with the pinion gear and ring gear having mating solid teeth, such as those shown in FIGS. 9A and 9B on the idler gears. Therefore, the present invention comprises a power tong unit having a gear train in which any of the gears therein comprise roller teeth elements.

Further, the present invention comprises a tong having a gear train comprising only the pinion gear, mating directly with the ring gear, and omitting the idler gears. Such arrangement may be particularly suitable for closed throat tong units.

It is to be further understood that the scope of the invention comprises a removable ring gear section having no gear teeth (of any configuration). Such embodiment would still yield the circumferential force transfer and stability (and prevent opening of the throat of the ring gear), while in other ways (e.g. complete rotation of the ring gear) would function as an open throat ring gear.

The Removable Section of the Ring Gear, and Tong Body Door

The present invention further comprises a tong unit having a means for removing a removable section of the ring gear (where it may lock in by virtue of mating slots and keys), by lifting same so as to disengage the removable section from the ring gear keys, then rotating the removable section, along with the tong body door, so as to yield an open throat to the ring gear and tong body.

Figure 10:
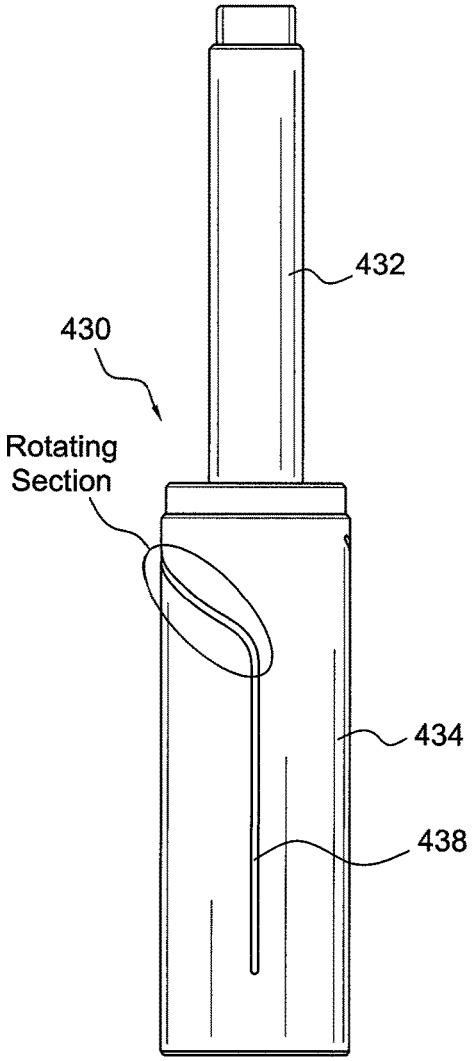
FIGS. 10 and 11 show further detail of the hydraulic cylinder mechanism, for moving the removable section of the ring gear, and tong body door, being an embodiment of certain principles of the invention.
Figure 11:
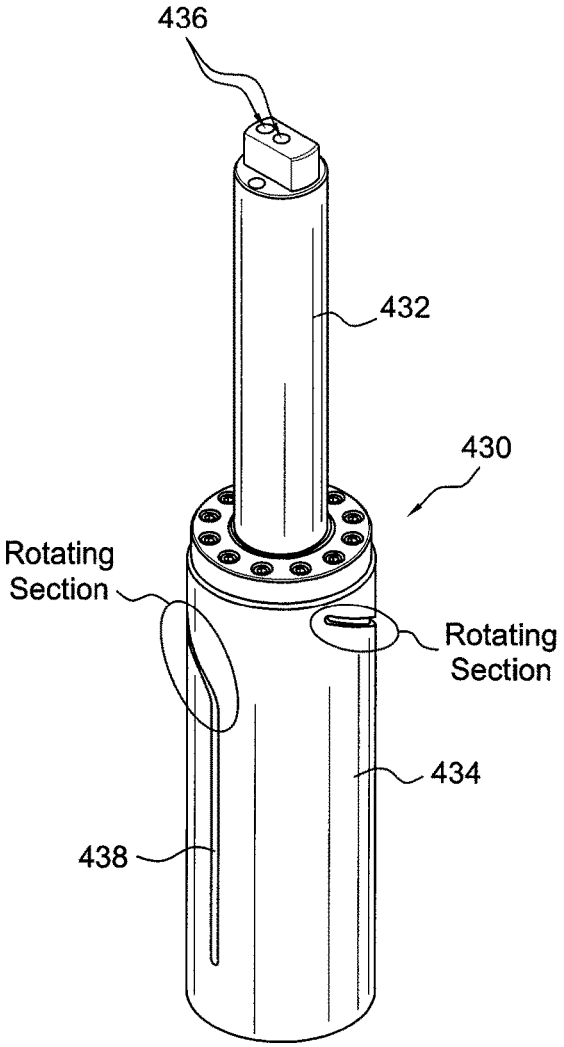

Referring to the drawings, in particular FIGS. 1, 2, and 10-14: in order to open the tong so as to insert or remove a tubular from the tong (or, as previously explained, to move the tong into position around the tubular), ring gear 40 is rotated such that removable section 45 is first rotated into position within tong door 400, such that removable section 45 is aligned with tong door 400, as in FIG. 1. The means for removing removable section 45 comprises a hydraulic caliper mechanism or clamp 410 within tong door 400, which grips removable ring gear section 45, generally squeezing removable section 45 between two plates. Next, hydraulic cylinder 430, inside of hydraulic cylinder housing 420, lifts both tong door 400 and removable section 45 (held within tong door 400) upward, out of engagement with ring gear 40, then rotates so as to move tong door 400 and removable section 45 to the position shown in FIG. 2, completely opening the throat of the tong so that tubulars can be inserted and removed. FIGS. 10 and 11 show further detail of hydraulic cylinder 430. Shaft 432 telescopes within body 434, via action of hydraulic fluid through ports 436. Shaft 432 has one or more pins (not shown) which travel within pin slots 438 with movement of shaft 432; preferably, two pins and mating slots are provided. Pin slots 438, as can be seen in FIGS. 10 and 11, restrain shaft 432 to translation only (that is, no rotation) during a first part of travel of shaft 432, then the pins must follow pin slots 438 as said slots wrap around the circumference of body 434 (denoted as "rotating section" on the drawings), resulting in rotation of shaft 432. This rotation of shaft 432 also causes rotation of tong door 400 with removable ring gear section 45 therein, as described above.

Figure 12:
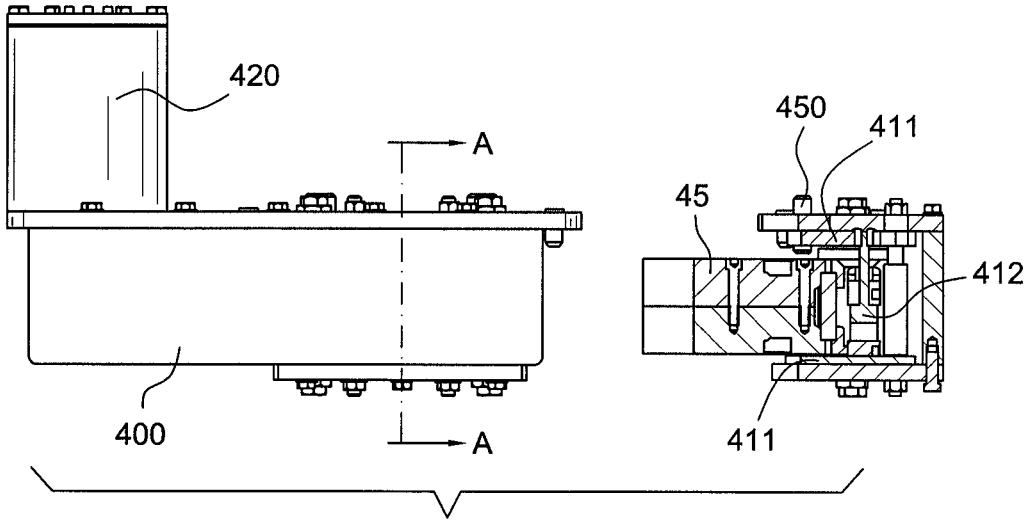
FIGS. 12-14 show additional detail of the means for moving the removable section of the ring gear.
Figure 13:
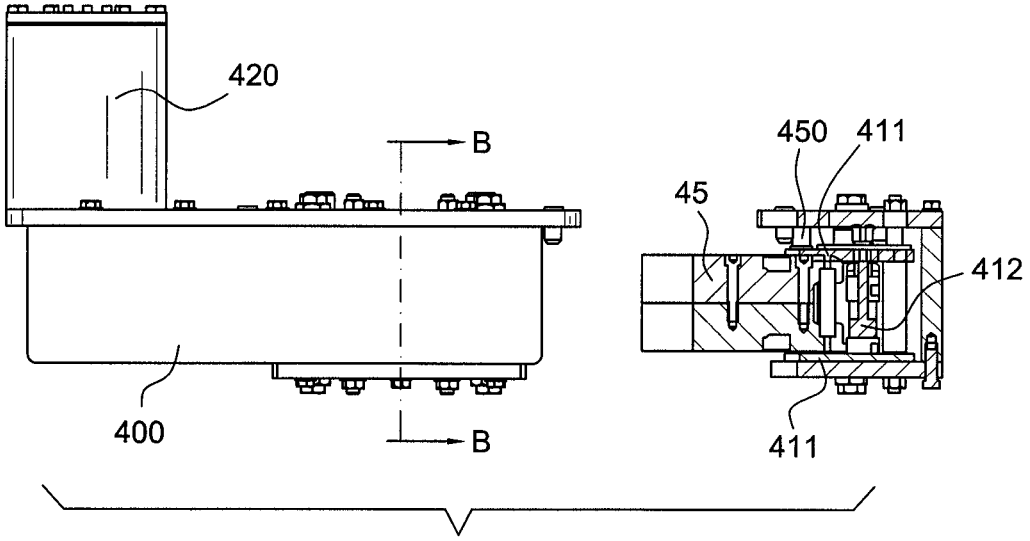
Figure 14:
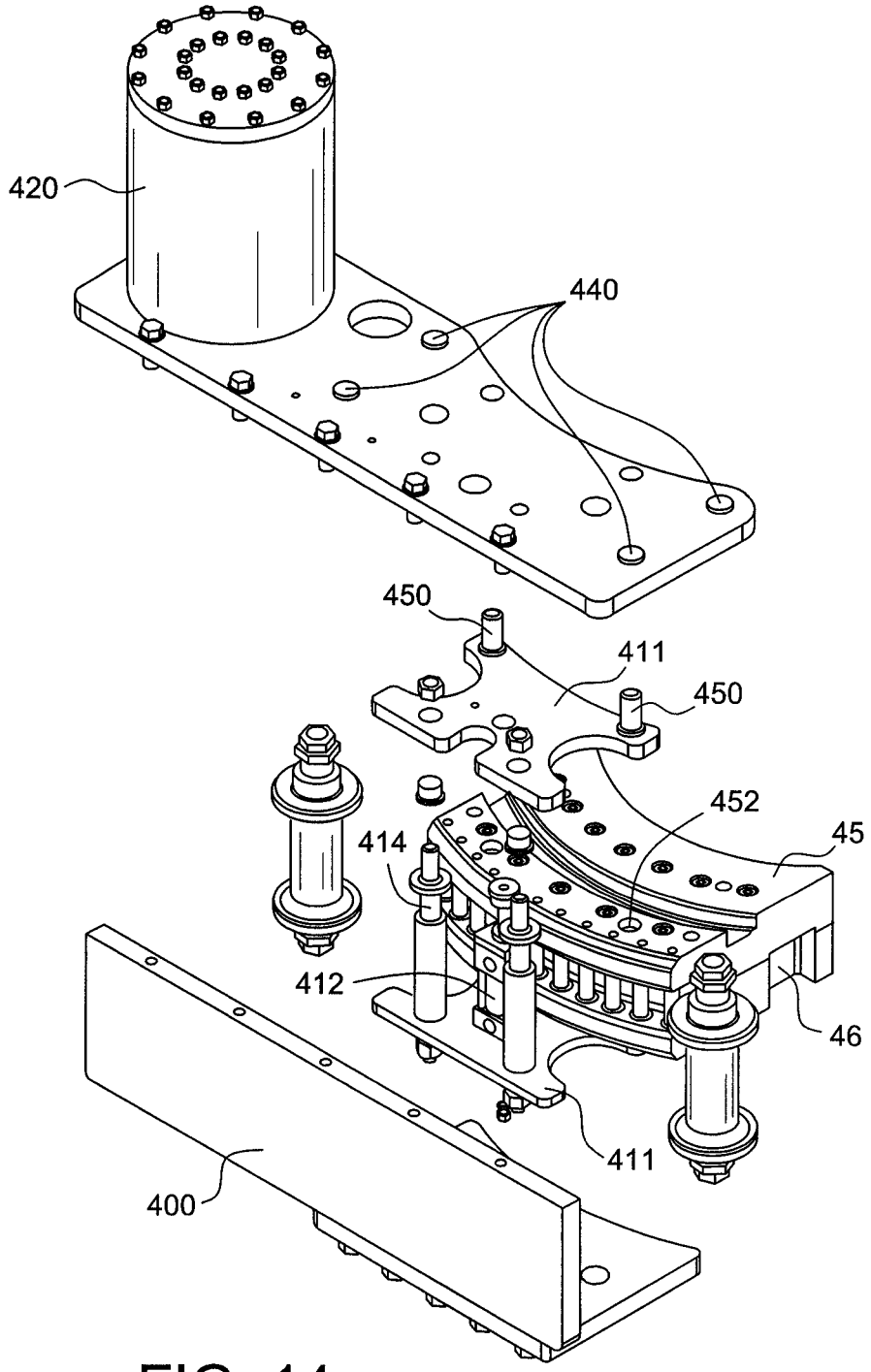

FIGS. 12 and 13 show additional detail regarding the means for removing removable section 45. In FIG. 12, removable section 45 is positioned between plates 411, but plates 411 are not being forced together by hydraulic cylinder 412. In FIG. 13, hydraulic cylinder 412 has forced plates 411 together, thereby capturing removable section 45 therebetween, in preparation for lifting same out of engagement with ring gear 40, and swinging it out of the way in order to move a tubular within ring gear 40. FIG. 14 is an exploded view of the means for removing removable section 45, showing plates 411 in relation to removable section 45; hydraulic cylinder 412, which moves plates 411; and guide pins 414 on which plates travel. Preferably, one or more retaining/alignment pins 450 are provided, as can be seen in FIGS. 12-14. In a preferred embodiment, retaining/alignment pins 450 are fixed to the upper plate 411, with a beveled nose portion extending beyond the surface of upper plate 411, that is the surface facing removable section 45. This beveled nose portion (which can be best seen in FIG. 12), when plates 411 are contacting removable section 45, enters a mating hole 452 in removable section 45, best seen in FIG. 14. This pin/hole engagement provides a positive mechanical retention of removable section 45 by plates 411, and due to the beveled nose entering a mating beveled hole provides a self-aligning function. The upper end of retaining/alignment pins 450 are preferably configured so as to extend above the surface of tong door 400, when plates 411 are not engaged with removable section 45 (the position shown in FIG. 12); then when plates 411 are positively engaged with removable section 45, the upper end of retaining/alignment pins 450 are substantially flush with the upper surface of tong door 400 (the position shown in FIG. 13), thus providing an indication of when plates 411 are engaged with and gripping removable section 45.

It is to be noted that when tong door 400 is in the closed position, see FIG. 1, pins 440 in tong door 400 lock into tong body 20, so as to prevent the throat of tong body 20 from opening up under load (pins 440 also shown in FIG. 14).

It is understood that hydraulic fluid supplies, controls, etc. are provided in order to operate the various parts of tong unit 10, as is known in the art.

Materials

Materials for the various components of the tong unit are those well known in the art, including high strength steels, suitable bushing materials, non-metallic parts where suitable, etc.

Conclusion

While the foregoing description sets out specificities regarding one presently preferred embodiment of the invention, it is to be understood that various changes may be made to the described embodiments while remaining within the scope of the invention. For example:

sizes of the various components, and the overall tong unit, may be varied to suit particular requirements; and various aspects of the invention, namely the roller gear tooth elements, are applicable to both open throat and closed throat tong units.

Therefore, the scope of the invention is not to be limited by the disclosed embodiments, but by the appended claims and their legal equivalents.

I claim:

1. A power tong unit for the makeup and breakout of threaded tubulars, comprising a gear train, wherein said gear train comprises:

a pinion gear rotated by a power means;

a ring gear driven directly or indirectly by said pinion gear;

wherein said ring gear comprises:

a circumferential groove about an outer edge of said ring gear, forming a circumferential groove thereabout and spaced-apart upper and lower lips bounding said groove;

a plurality of aligned pairs of holes extending at least partially through said upper and lower lips and spaced about a circumference of said upper and lower lips; and a plurality of roller tooth elements captured in said aligned pairs of holes, spanning the space between said upper and lower lips.

2. The power tong unit of claim 1, wherein said ring gear is split into upper and lower plates, said upper and lower plates held together by bolts.

3. A power tong unit for the makeup and breakout of threaded tubulars, comprising:

a ring gear, wherein said ring gear comprises a circumferential groove about an outer edge of said ring gear and spaced-apart upper and lower lips bounding said groove;

a plurality of aligned pairs of holes extending at least partially through said upper and lower lips and spaced about a circumference of said upper and lower lips;

a plurality of roller tooth elements disposed in said aligned pairs of holes, spanning the space between said upper and lower lips, wherein said ring gear is split into upper and lower plates, said upper and lower plates held together by bolts.

4. The power tong unit of claim 3, wherein said roller tooth elements are installed by separating said upper and lower plates, placing one end of said roller tooth elements into said holes in one or said upper and lower plates, then fitting the other of said upper and lower plates over the other end of said roller tooth elements and and bolting said upper and lower plates together, thus capturing said roller tooth elements therebetween.

* * * * *